US008567287B2

(12) United States Patent
Gapp et al.

(10) Patent No.: US 8,567,287 B2
(45) Date of Patent: Oct. 29, 2013

(54) REVERSIBLE OPEN-ENDED RATCHET WRENCH

(76) Inventors: Steve Gapp, Dousman, WI (US); Clint Johnson, Dousman, WI (US); Reed Felton, Wauwatosa, WI (US)

( * ) Notice: Subject to any disclaimer, the term of this patent is extended or adjusted under 35 U.S.C. 154(b) by 152 days.

(21) Appl. No.: 13/300,494

(22) Filed: Nov. 18, 2011

(65) Prior Publication Data

US 2012/0060652 A1 Mar. 15, 2012

Related U.S. Application Data

(63) Continuation-in-part of application No. 12/419,791, filed on Apr. 7, 2009, now abandoned.

(51) Int. Cl.
*B25B 13/46* (2006.01)

(52) U.S. Cl.
USPC ..... 81/63; 81/60; 81/61; 81/62; 81/63.1; 81/63.2

(58) Field of Classification Search
USPC ..... 81/60–63.2
See application file for complete search history.

(56) References Cited

U.S. PATENT DOCUMENTS

| | | | | |
|---|---|---|---|---|
| 1,561,812 | A | 11/1925 | White | |
| 1,585,825 | A | 5/1926 | Bessolo | |
| 1,781,994 | A | 11/1930 | Wilson | |
| 2,720,127 | A | 10/1955 | Bonniwell | |
| 2,814,226 | A | 11/1957 | Lojczyc | |
| 3,635,654 | A | 1/1972 | McFarland | |
| 3,673,986 | A | 7/1972 | Vardaman | |
| 4,065,986 | A | 1/1978 | Meggs et al. | |
| 5,467,672 | A | 11/1995 | Ashby | |
| 5,501,124 | A | 3/1996 | Ashby | |
| 2004/0083858 | A1* | 5/2004 | Carnesi | 81/63 |
| 2005/0011315 | A1* | 1/2005 | Chen | 81/63.1 |
| 2006/0117913 | A1* | 6/2006 | Chen | 81/63.1 |
| 2006/0123954 | A1 | 6/2006 | Arnold | |
| 2010/0229694 | A1* | 9/2010 | Chen | 81/63.1 |
| 2010/0269639 | A1* | 10/2010 | Sroka | 81/58.2 |

* cited by examiner

*Primary Examiner* — Monica Carter
*Assistant Examiner* — Danny Hong

(57) ABSTRACT

The present invention relates to the field of open-ended wrenches, and more specifically to a dual pawl assembly which can be used within an open-ended ratchet wrench to facilitate a bi-directional ratcheting motion.

15 Claims, 6 Drawing Sheets

REVERSIBLE OPEN-ENDED RATCHET WRENCH

CROSS-REFERENCE TO RELATED APPLICATIONS

This application is a continuation-in-part of U.S. application Ser. No. 12/419,791 filed on Apr. 7, 2009 now abandoned.

FIELD OF INVENTION

The present invention relates to the field of open-ended wrenches, and more specifically an open-ended ratchet wrench with a dual pawl assembly which facilitates bi-directional ratcheting motion.

GLOSSARY

Figure 1:
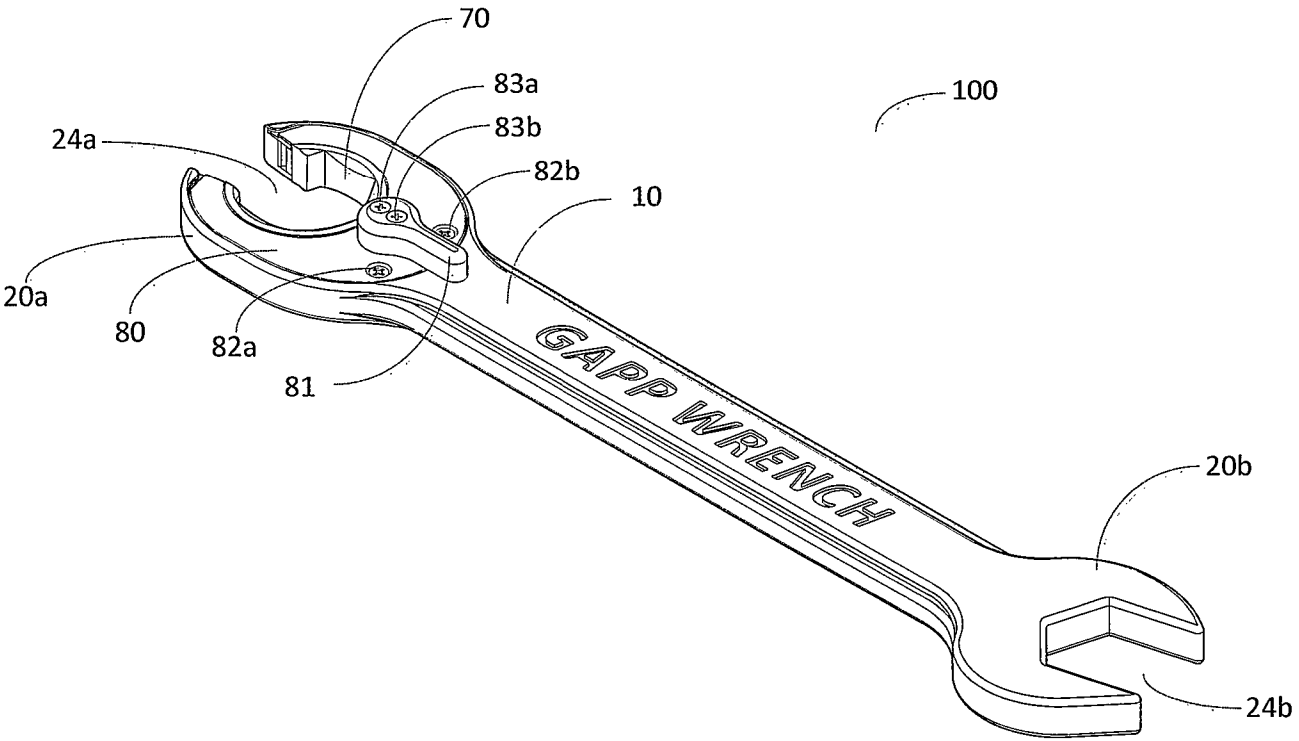
FIG. 1 illustrates an isometric view of an exemplary embodiment of an open-ended ratchet wrench.

As used herein, the term "alternately engage" means to engage at alternate positions during a series of rotational movements in either direction.

As used herein, the term "change detent" means a component with grooves or notches that is used to mechanically resist and enable rotation.

As used herein, the term "coil spring" means any spring of wire coiled helically, having a cylindrical or conical outline.

As used herein, the term "flex spring band" means any flexible piece of material which exerts a force at either end when pressure from other components is used to bend it, forcing the ends in opposite direction. A flex spring band may include a leaf spring, piece of sheet metal, piece of plastic, or a wire, As used herein, the term "portion" means a subset or part of a whole which is less than all.

As used herein, the term "protuberance" means any bulge, knob, projection, or swelling, which protrudes.

As used herein, the term "ratcheted crescent" means a c-shaped component with an outer rim having a plurality of ratchet teeth attached.

As used herein, the term "ratchet engaging teeth" means a structural component of a pawl, which may be of varying sizes and configurations, used to engage the teeth of a ratchet.

As used herein, the term "v-pawl" means a pawl, or movable component which has two lever arms in the shape of a "V," which operates as a lever and which includes teeth which engage a ratchet.

As used herein, the term "v-pawl lever arm" means an elongated section protruding from a v-pawl.

BACKGROUND

A ratchet wrench is a type of wrench having ends that surround the nut or head of a bolt. The wrench provides a mechanical advantage by applying torque to turn bolts, nuts or other items designed to interface with a wrench. The ratcheting mechanism allows the nut or bolt to be tightened or loosened with a reciprocating motion of the wrench, without requiring that the wrench be removed, refitted, and repositioned after each turn.

A ratchet wrench includes ratchet and pawl components known in the mechanical arts to control and secure movement. Ratchets consist of a ratchet wheel, and may include a spring assembly which applies pressure to a pivoting spring loaded finger called a pawl that engages the teeth. Either the teeth, or the pawl, are slanted at an angle, so that when the teeth are moving in one direction, the pawl slides up and over each tooth in turn, with the spring forcing it back with a 'click' into the depression before the next tooth. When the teeth are moving in the other direction, the angle of the pawl causes it to catch against a tooth and stop further motion in that direction.

More specifically, a pawl is a movable component which operates as a lever and which includes protuberances which engage a ratchet. The pawl is used to control the direction of the ratchet. In various embodiments, bolt engaging components may be used to apply pressure to a pawl (e.g., a spring loaded component) to keep a pawl engaged within the teeth of a ratchet. A pawl may be machined, stamped or molded and constructed of one or more components having singular or multiple protuberances.

Generally, a ratchet wheel is similar to other types of gear wheels, except that its teeth or cogs may be cut with a sloped side and a "straight" or "offcut" side. That is in contrast to the two sloped sides of the tooth or cog on a regular gear wheel. Additionally, there is usually a curve in the slope of the "regular" side that acts as a ramp for the pawl to ride on. The pawl, which is usually spring loaded to keep it engaged with the teeth, will, when the ratchet wheel is rotated in one direction, slide up or "climb" the slanted or sloped side of a tooth. The pawl will then "jump" down into the bottom of the tooth space after going over the tip of the tooth, and the spring will have pushed it there. It will then ride up the next slope on the next tooth as the ratchet wheel moves in the same "forward" direction. But if the ratchet wheel is rotated in a "backward" direction, the pawl will only allow movement until it comes in contact with the "straight" side of the next tooth back and it will jam there. This will limit backward movement of the ratchet wheel to a tooth length and no more, as long as the pawl is acting normally to check the backward rotation.

Reversible ratchet wrenches are also known in the art. A reversible ratchet wrench has a handle portion and a head portion. Key features of a reversible ratchet wrench include one or two pawls having teeth which alternately engage the teeth on a ratchet wheel. In the case of two pawls, both pawls typically share a common pivot point. A lever determines the direction in which torque force is applied by engaging one pawl or the other. As seen in ratchet wrenches known in the art, one of the two pawls will engage the ratchet while the other pawl does not. One pawl will contain protuberances or teeth adapted to allow the ratchet to apply torque in one direction while the other pawl contains protuberance or teeth in an opposite configuration to allow the ratchet to apply torque in the other direction. Likewise, when a single pawl assembly is used, only one side of the pawl is engaged at a time. The torque force of the ratchet is alternately applied, the pressure released, and the ratchet wrench repositioned for the next application of torque force.

One problem generally known in the art with box type wrenches using ratchet and pawl systems is that the head of the wrench is generally closed, and threaded components (such as brake lines) will not allow the wrench to fit over them.

Various attempts are known in the art to create an open-ended ratchet wrench. However, these wrenches require a large rotational degree in order to use the wrench which is not possible in confined spaces. The need for a large rotational movement lessens the utility of these wrenches. If a large degree of motion is required to rotate the ratchet, the wrench cannot be used in smaller spaces. Attempts are also known in the art to create more efficient ratcheting mechanisms.

A need exists for an open-ended ratchet wrench assembly that can rotate a ratchet within small degrees, known as ratcheting arc to a person of ordinary skill in the art.

It is desirable to introduce an open-ended box wrench using a ratchet and dual pawl system which can operate at small rotational degrees (ratcheting arc) and which can be affordably manufactured and mass produced, and which does not require specialized parts or multi-component pawl assemblies.

SUMMARY OF THE INVENTION

The present invention is a reversible open-ended ratchet wrench which utilizes a dual v-pawl ratchet assembly comprised of an open-ended wrench housing having a cavity to enclose critical ratchet assembly.

In various embodiments the ratchet assembly components may include a ratcheted crescent with an outer ratchet edge including a plurality of ratchet teeth. The cavity further includes at least two pivotal v-pawl components.

Each of the v-pawl components is comprised of two angled v-pawl lever arms positioned at a critical angle of 90 to 150 degrees relative to each other. The v-pawl lever arms have an outer end from which a plurality of ratchet engaging teeth are formed. The ratchet engaging teeth of each of the v-pawl lever arms alternately engage a portion of the ratchet teeth all times.

In various embodiments a multi-position change detent can be used to exert a variable force on said flex spring band when actuated by a thumb lever. The flex spring band is connected to each of the v-pawls and will cause them to pivot and engage the ratchet. Finally, the reversible ratcheted wrench includes a cover plate which separates the thumb lever and the multi-position change detent.

This configuration allows smaller for a reduced ratcheting arc of 50 percent and therefore a smaller wrench rotation of down to 2.5 degrees required to apply torque. The present invention further allows for a larger opening on the ratcheted crescent wheel because of the dual v-pawl assembly. The dual v-pawl assembly is advantageous because one pawl will always be in contact with the ratcheted crescent, even if one v-pawl passes over the open end of the ratcheted crescent.

DETAILED DESCRIPTION OF INVENTION

For the purpose of promoting an understanding of the present invention, references are made in the text to exemplary embodiments of a simplified open-ended ratchet wrench with dual v-pawl assembly only some of which are described herein. It should be understood that no limitations on the scope of the invention are intended by describing these exemplary embodiments. One of ordinary skill in the art will readily appreciate that alternate but functionally equivalent simplified open-ended ratchet wrenches with dual pawl assembly may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change in the basic function to which it is related. For example, a simplified open-ended ratchet wrench with dual pawl assembly may use two identical pawl mechanisms or may use two varied pawl components to engage opposite sides of the ratchet component.

FIG. 1 illustrates an isometric view of an exemplary embodiment of reversible open-ended ratchet wrench. Open-ended ratchet wrench 100 may be used to apply torque force in a clockwise or counter-clockwise direction and may also be placed in a neutral position where ratcheted crescent 70 can spin freely within open-ended wrench head 20*a*.

In the embodiment shown, open-ended ratchet wrench 100 includes an ergonomic handle and a standard open-ended box wrench. As seen in the embodiment of FIG. 1, open-ended ratchet wrench 100 has ratchet wrench housing 10, open-ended wrench heads 20*a* and 20*b* with head openings 24*a* and 24*b*. Also shown in the embodiment is partially exposed ratcheted crescent 70. Ratcheted crescent 70 is housed within open-ended wrench head 20*a*.

In the embodiment shown, open-ended wrench head 20*a* includes crescent shaped cover plate 80, corresponding to the shape of ratcheted crescent 70. Crescent shaped cover plate 80 is attached to the top of open-ended wrench head 20*a* and covers the top side of ratcheted crescent 70 and the inner assembly of ratchet wrench components (not shown in this figure). In the embodiment shown, crescent shaped cover plate 80 is attached to open-ended ratchet head 20*a* with cover plate screws 82*a* and 82*b*. In other embodiments, crescent shaped cover plate 80 may be attached using other attachment means known in the art such as welding, rivoting, adhesive, machining, intregally molding; soldering, or any other means known to one of ordinary skill in the art.

In the embodiment shown, open-ended ratchet wrench 100 includes thumb lever 81 which is located on top of crescent shaped cover plate 80, but thumb lever 81 may be located in other positions closer or further to open-ended wrench head 20*a*. In the embodiment shown, thumb lever 81 is a tear-drop shaped component with both a rounded and enlongated portion and attached by screws 83*a* and 83*b*. As shown in the embodiment, thumb lever 81 pivots around its rounded upper portion and is used to change the direction and amount of torque or rotational resistance applied to ratcheted crescent 70. Thumb lever 81 is used to actuate two internal v-pawls and a crescent-shaped ratchet component shown in subsequent drawings.

Figure 2:
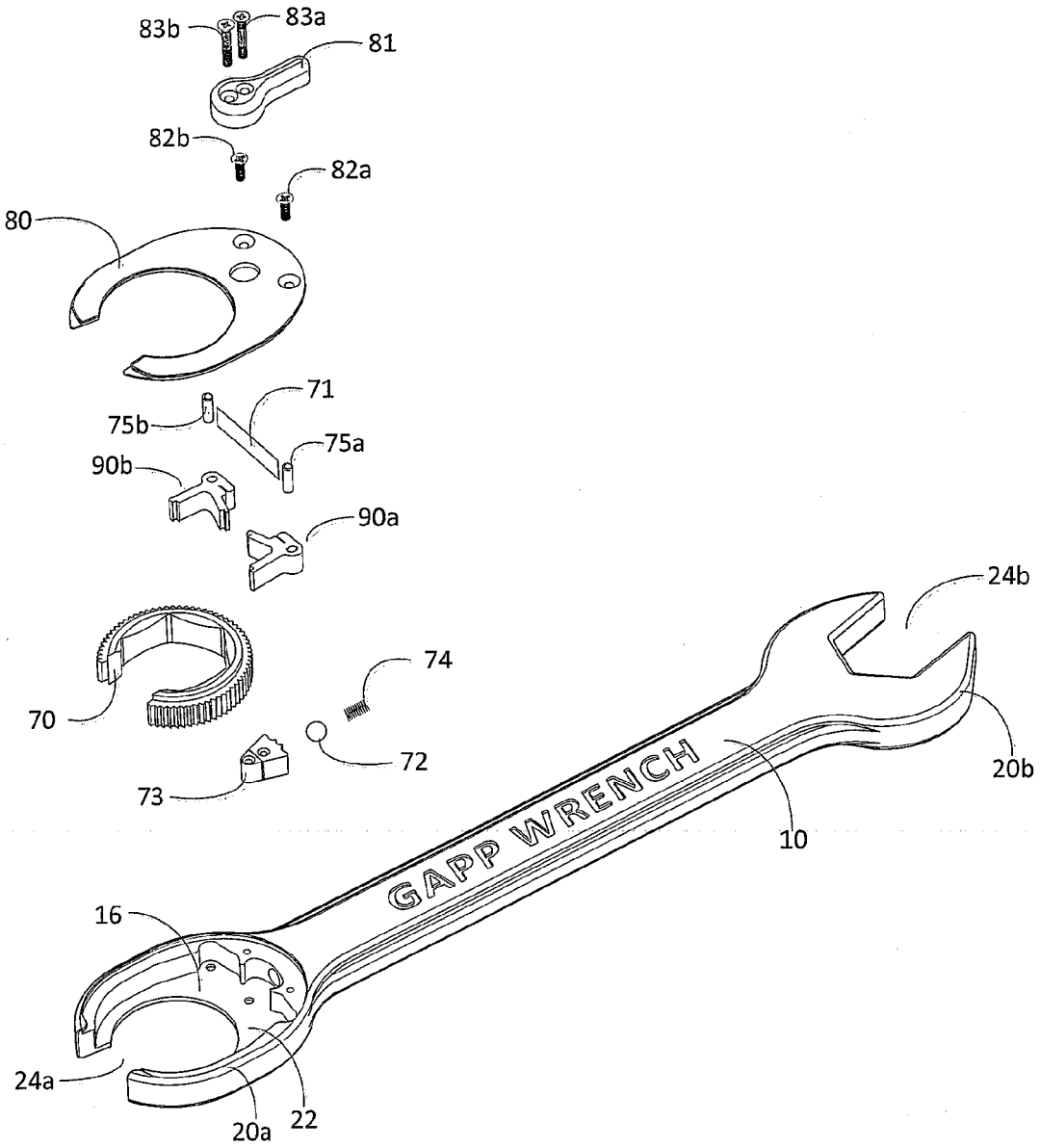
FIG. 2 illustrates an exploded view of an exemplary embodiment of open-ended ratchet components and a ratchet wrench housing with a cavity for ratchet wrench components.

FIG. 2 is an exploded view of an exemplary embodiment of open-ended ratchet components and ratchet wrench housing 10 with a cavity 22 for ratchet wrench components. In the embodiment shown, open-ended ratchet wrench components consist of ratcheted crescent 70, v-pawls 90*a* and 90*b*, leaf spring 71, hinge pins 75*a* and 75*b*, change detent 73, ball bearing 72, and coil spring 74. In the embodiment shown, crescent shape cover plate 80 contains the ratchet wrench components within cavity 22.

Figure 3:
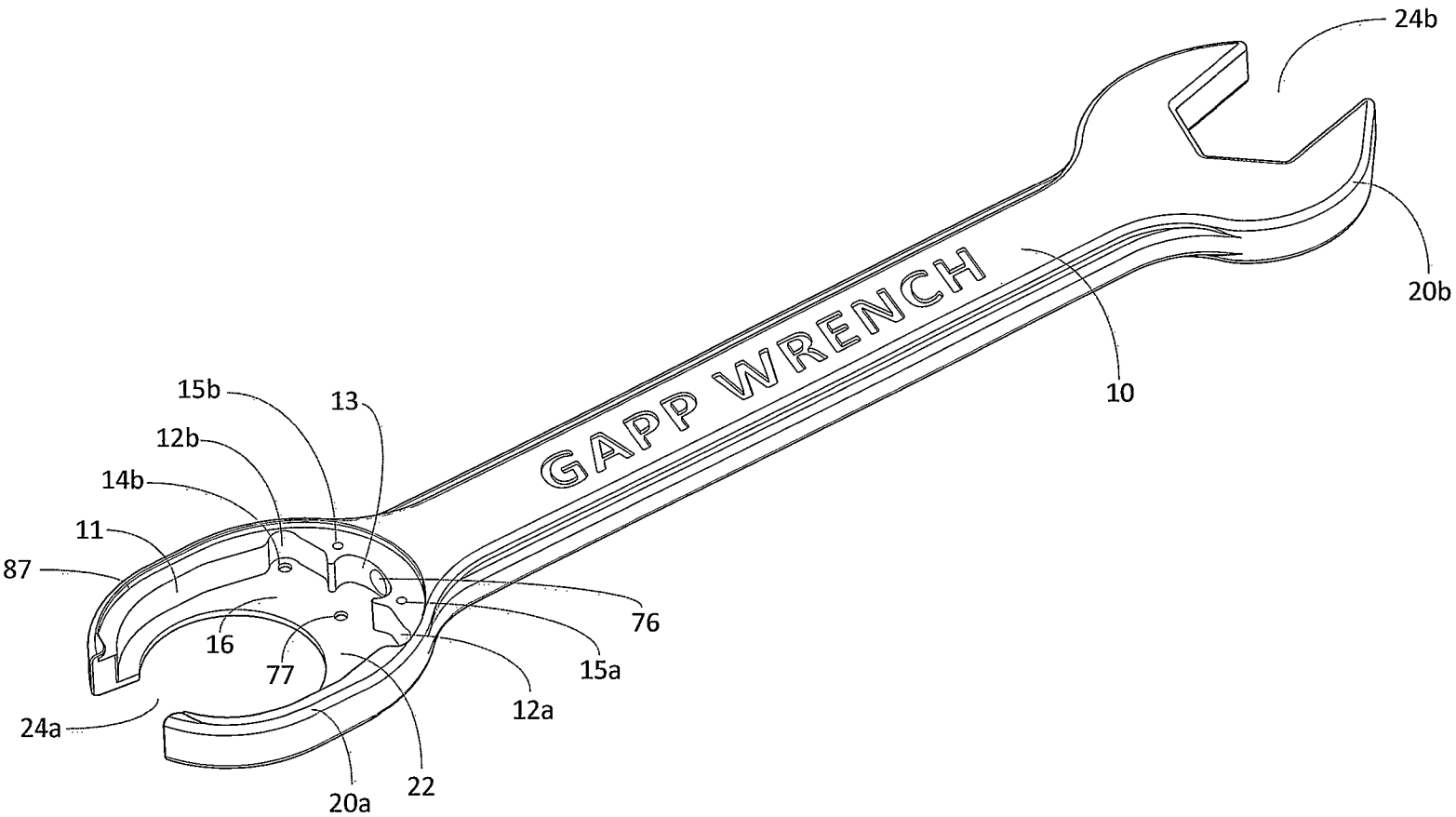
FIG. 3 illustrates a perspective view of an exemplary embodiment of a open-ended ratchet wrench housing with a cavity for ratchet wrench components

FIG. 3 illustrates a perspective view of exemplary embodiment of ratchet wrench housing 10 which includes cavity 22 for ratchet wrench components (shown in FIG. 2). Cavity 22 is critically contoured to receive and secure various ratchet wrench components. The critical contoured features of cavity 22 includes rounded inner surface 11 and a series of three indentations 12*a*, 12*b* and 13 at the end of rounded inner surface 11 which is most proximate to the wrench handle. V-pawl indentations 12*a* and 12*b* are symmetrical and accommodate v-pawls 90*a* and 90*b* (shown in FIG. 2). Change detent indentation 13 is a larger semi-circular contour to accommodate the upper rounded portion of changed detent 73 (shown in FIG. 2). Change detent indentation 13 further includes ball bearing aperture 76. Cavity 22 is also defined by bottom surface 16 which further includes change detent aperture 77 and hinge pin apertures 14*a* and 14*b*.

As shown in the embodiment, cavity 22 is surrounded by securing rim 87 which is protrusion or edge that spans the outer rim of open-ended wrench head 20*a*. Apertures 15*a* and 15*b* receive plate screws 82*a* and 82*b* to fixedly attach crescent shaped cover plate 80 to ratchet wrench housing 10.

Figure 4:
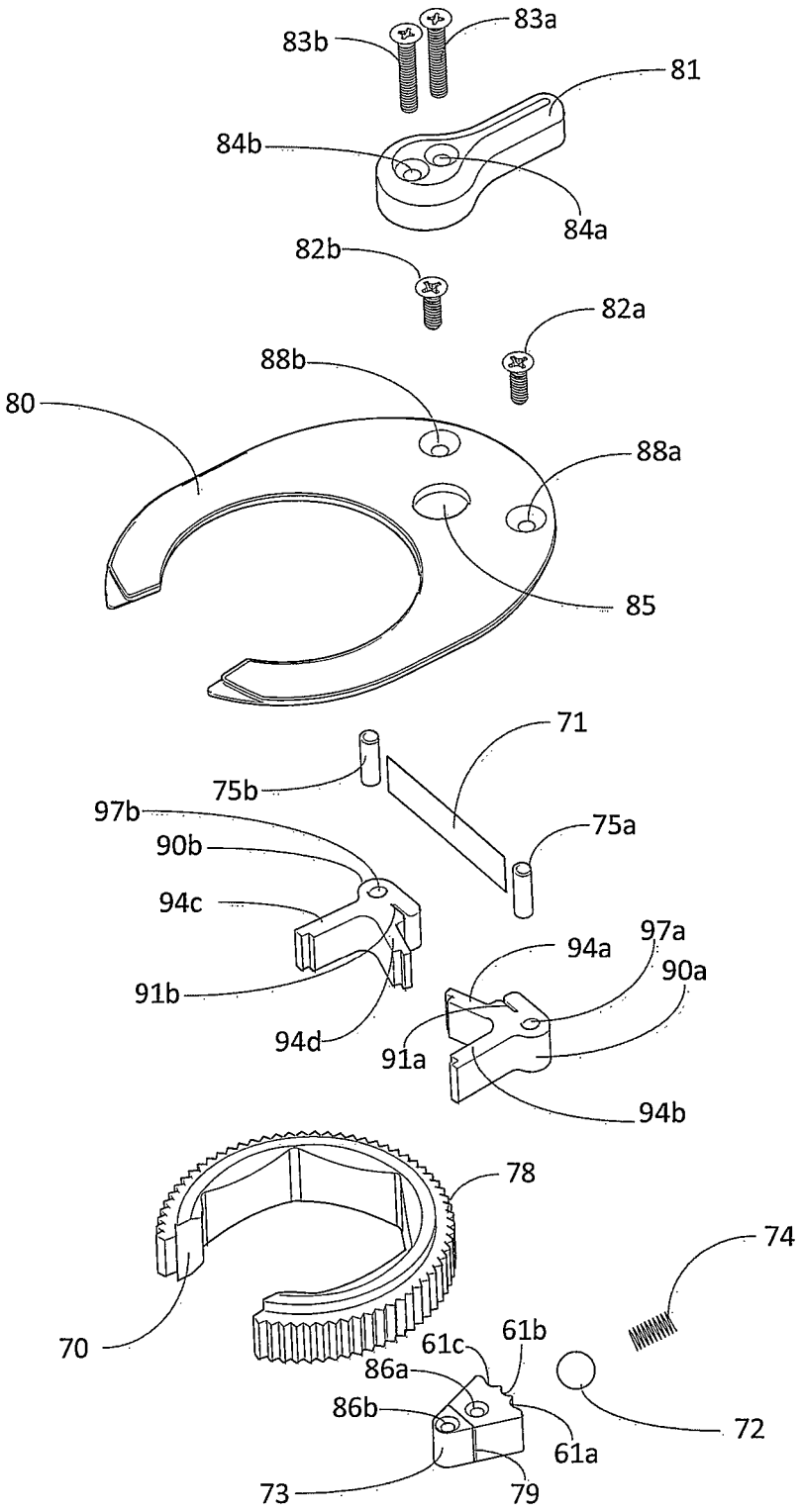
FIG. 4 illustrates an exploded view of an exemplary embodiment of open-ended ratchet wrench components.

FIG. 4 is an exploded view of an exemplary embodiment of open-ended ratchet wrench components. As shown in the embodiment, v-pawls 90*a* and 90*b* are curved components with v-pawl lever arms 94*a*, 94*b*, 94*c*, and 94*d* in the shape of a "V." In other embodiments, v-pawls may have more than two v-pawl lever arms each. In the embodiment shown, v-pawls 90*a* and 90*b* are positioned so that v-pawl lever arms 94*a*, 94*b*, 94*c*, and 94*d* may engage ratchet teeth 78 on ratcheted crescent 70. V-pawls 90*a* and 90*b* also include v-pawl slits 91*a* and 91*b*. Further, in the embodiment shown, v-pawls 90*a* and 90*b* include v-pawl apertures 97*a* and 97*b* which receive hinge pins 75*a* and 75. Hinge pins 75*a* and 75*b* are pivoting components which allow v-pawls 90*a* and 90*b* to pivot around hinge pins 75*a* and 75*b* at a rotation of 1 to 90 degrees. In other embodiments, hinge pins 75*a* and 75*b* may be other devices known in the art to allow v-pawls 90*a* and 90*b* to pivot or rotate around apertures 97*a* and 97*b*. Hinge pins 75*a* and 75*b* engage hinge pin aperatures 14*a* and 14*b* (shown in FIG. 3) and v-pawl apertures 97*a* and 97*b*, thus allowing v-pawls 90*a* and 90*b* to pivot.

As shown in the embodiment, ratcheted crescent 70 is an open-ended ratchet wheel in the shape of a crescent located within cavity 22. Ratcheted crescent 70 has a pluarlity of proturbences or ratchet teeth 78 on its outer ratchet edge. Various embodiments of ratcheted crescent 70 may include more, fewer or differently proportioned ratchet teeth. In the embodiment shown, the inside of ratcheted crescent 70 is designed to match or correspond to a standard standard six-sided or hexagonal shaped nut, bolt head, or other hardware. In other embodiments, the inside of ratcheted crescent 70 may be designed to accommodate or engage other shaped mechanical pieces or hardware.

In the embodiment shown, change detent 73 has three grooves 61*a*, 61*b*, and 61*c* on its base side which are in contact with ball bearing 72. Ball bearing 72 is held in contact with change detent 73 by coil spring 74. Ratchet wrench housing 10 includes coil spring aperture 76 (shown in FIG. 3) which is located within change detent indentation 13. Coil spring 74 is located inside of coil spring aperture 76 (shown in FIG. 3) along with ball bearing 72. Coil spring 74 forces ball bearing 72 to engage or contact the grooves 61*a*, 61*b*, and 61*c* of change detent 73.

As shown in the embodiment, change detent 73 also has change detent slit 79. One end of leaf spring 71 is wedged into v-pawl slit 91*a* on v-pawl 90*a* while the other end is wedged into v-pawl slit 91*b* on v-pawl 90*b*. The middle of leaf spring 71 is wedged into change detent slit 79.

As shown in the embodiment, thumb lever 81 is located on top of crescent shape cover plate 80 and is attached to change detent 73 by screws 83*a* and 83*b* into change detent apertures 86*a* and 86*b*. Screws 83*a* and 83*b* go through hole 85 in crescent shaped cover plate 80. In other embodiments, thumb lever 81 may be attached to change detent 73 with only one screw or by other attachment devices known to one of ordinary skill in the art.

Figure 5:
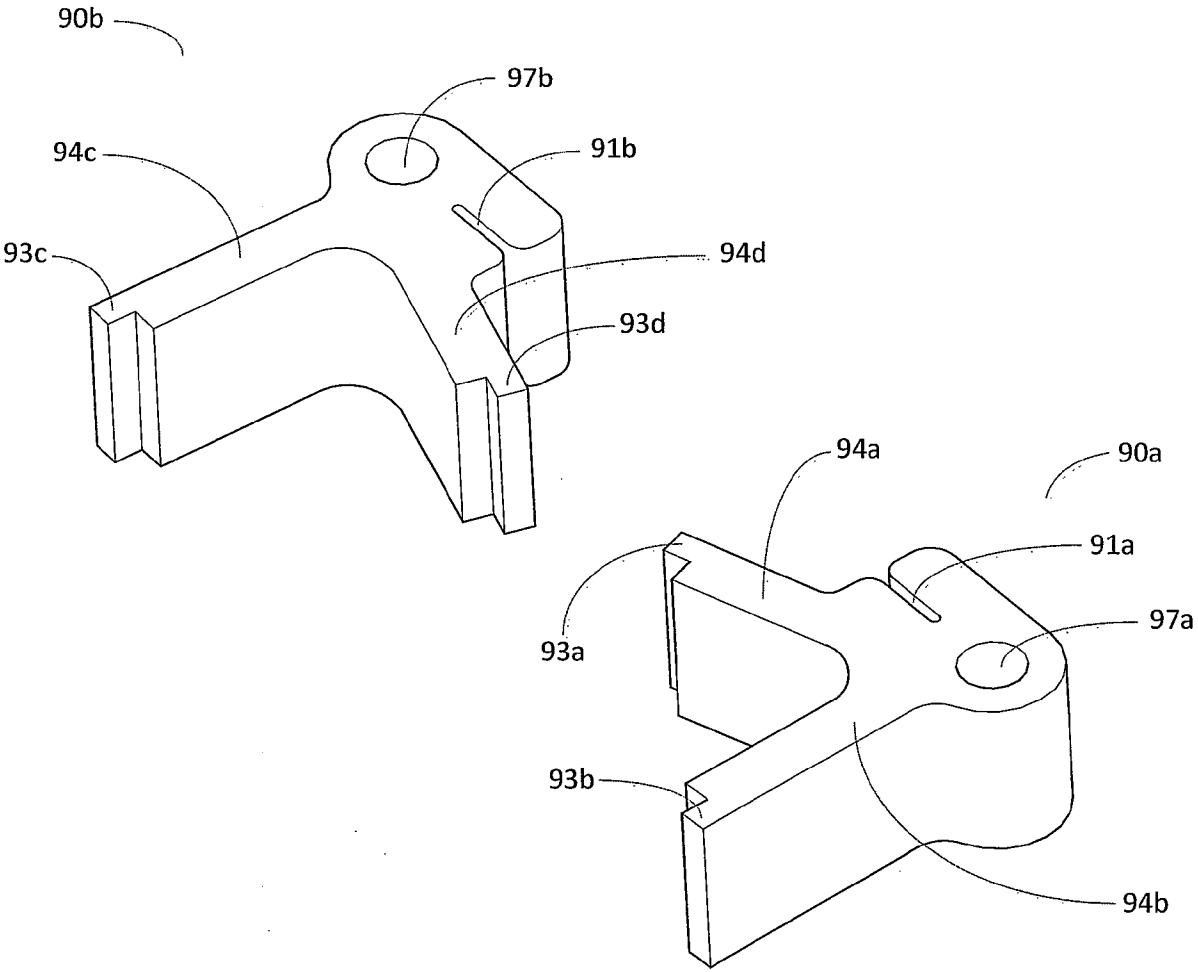
FIG. 5 illustrates an isolated view of an exemplary embodiment of a pair of v-pawls.

FIG. 5 illustrates an isolated close up view of an exemplary embodiment of v-pawls 90*a* and 90*b*. In the embodiment shown, v-pawls 90*a* and 90*b* have two v-pawl lever arms each, 94*a*, 94*b*; 94*c*, and 94*d*. In other embodiments, v-pawl components 90*a* and 90*b* may have fewer or more v-pawl lever arms. In the embodiment shown, v-pawls 90*a* and 90*b* also include ratchet engaging teeth 93*a*, 93*b*, 93*c*, and 93*d* at the end of v-pawl lever arms 94*a*, 94*b*, 94*c*, and 94*d*. In other embodiments, ratchet engaging teeth may vary in size, shape and length designed to interact with ratchet teeth 78 (shown in FIG. 4).

Figure 6:
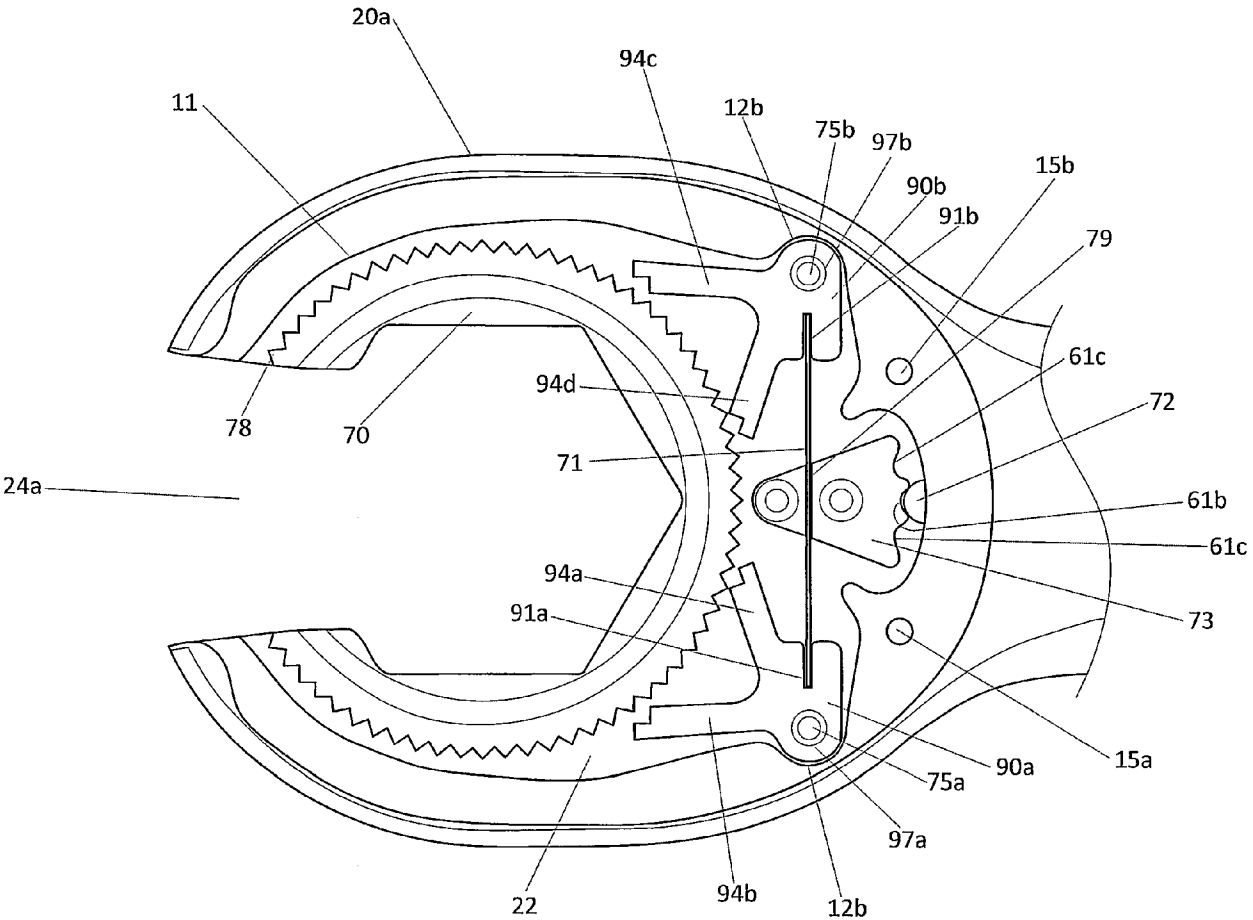
FIG. 6 illustrates a top view of an exemplary embodiment of an open-ended ratchet wrench assembly.

FIG. 6 is a top view of an exemplary embodiment of open-ended wrench head 20*a* withoutout cover plate 80 and thumb lever 81. In the embodiment shown, cavity 22 contains ratcheted crescent 70, v-pawls 90*a* and 90*b*, leaf spring 71, hinge pins 75*a* and 75*b*, change detent 73, ball bearing 72, and coil spring 74 (not shown). Cavity 22 consists of rounded inner surface 11 adapted to accommodate the shape of ratcheted crescent 70. Further, v-pawl indentation 12*a* and 12*b* are contoured accordingly to accommodate the shape of v-pawls 90*a* and 90*b* while change detent indentation 13 is contoured to accommodate the shape of change detent 73.

As seen in the embodiment of FIG. 6, leaf spring 71 is located between v-pawls 90*a* and 90*b*. Leaf spring 71 is a flex spring band adapted to rotate or pivot v-pawls 90*a* and 90*b* when force is applied. In the embodiment shown, the ends of leaf spring 71 are wedged in the v-pawl slits 91*a* and 91*b* of v-pawls 90*a* and 90*b*. In other embodiments, the ends of leaf spring 71 may be fixedly attached to v-pawls 90*a* and 90*b* by welding, adhesives, or any other attachment means known to one of ordinary skill in the art. Also, in other embodiments, leaf spring 71 may also be other types of flex spring bands affixed to change detent 73 and v-pawls 90*a* and 90*b* adapted to rotate v-pawls when the change detent is rotated.

As seen in the exemplary embodiment, leaf spring 71 is attached in its middle to change detent 73. In the embodiment shown, change detent 73 is a triangular shaped component which has three grooves 61*a*, 61*b*, and 61*c* on its base side corresponding to multiple positions. Change detent 73 has change detent slit 79 where it is attached to leaf spring 71. The bottom of change detent 73 has a small proturbance which fits into to the change detent aperture 77 (seen in FIG. 3). The small proturbance on the bottom of change detent 73 allows change detent 73 to pivot about change detent aperture 77. In other embodiments change detent 73 may be other shapes which have grooves or notches. Change detent 73 also includes change detent apertures 84*a* and 84*b* where thumb lever screws 83*a* and 83*b* attach change detent 73 to thumb lever 81 (shown in FIG. 2).

As shown in the embodiment, if change detent 73 is pivoted counter-clockwise, leaf spring 71 will bend and slightly pivot v-pawls 90*a* and 90*b* in a clockwise direction and the ends v-pawl lever arms 94*b* and 94*d* will engage with ratcheted crescent 70. The angle of v-pawl lever arms 94*b* and 94*d* will allow ratchet teeth 78 to slide over ratchet engaging teeth 93*b* and 93*d* when ratcheted crescent is rotating in a clockwise direction. However, if ratcheted crescent 70 rotates in a counter-clockwise direction, ratchet engaging teeth 93*b* and 93*d* will catch and v-pawls 90*a* and 90*b* will lock in place, and the user may then apply torque to ratcheted crescent 70. The opposite is also true if change detent 73 slightly rotates in the clockwise position; ratcheted crescent 70 will be able to rotate counter-clockwise but not clockwise. If change detent 73 remains in the neutral or middle position, no v-pawl lever arms will be engaged and ratcheted crescent can freely rotate in either direction.

This embodiment allows for a smaller ratcheting arc and therefore a smaller wrench rotation of down to 2.5 degrees, or less depending on the number of ratchet teeth. In the exemplary embodiment shown, ratcheting arc is calculated using the equation:

$$\text{Ratcheting Arc}^\circ = \frac{360^\circ}{\text{Number of Teeth on Ratchet}} \times \frac{1}{2}$$

As seen in the embodiment, change detent 73 has three positions caused by the contact between ball bearing 72 and grooves 61*a*, 61*b*, and 61*c* on change detent 73; these positions represent neutral, clockwise torque, or counter-clockwise torque. In other embodiments, change detent 73 may have a plurality or multiple grooves or positions which may be used to apply variable rotational resistance to ratcheted crescent 70. Change detent 73 is held in place and restricted from rotating because of the pressure exerted by ball bear bearing 72 in grooves 63*a*, 63*b*, or 63*c* and the frictional resistance between change detent 73 and crescent shaped cover plate 80. Change detent 73 will not rotate until a user rotates thumb lever 81 (shown in FIG. 2). When a user rotates thumb lever 81, change detent 73 shifts into a new position, thus moving ball bearing 72 into another groove and locking it in position. Depending on the position of thumb lever 81, change detent 73 will apply varying degrees of pressure to leaf spring 71 in different directions; leaf spring 71 will force v-pawls 90*a* and 90*b* to pivot and engage ratcheted crescent 70.

What is claimed is:

1. A reversible ratchet wrench comprised of:

a housing which encloses a ratcheted crescent, at least two pivotal v-pawl components, at least one flex spring band, a multi-position change detent, and a cover plate;

wherein said ratcheted crescent has an outer ratchet edge including a plurality of ratchet teeth;

wherein said at least two pivotal v-pawl components each have two angled v-pawl lever arms, said v-pawl lever arms positioned at an angle of 90 and 150 degrees relative to each other, wherein each of said v-pawl lever arms has an outer end from which a plurality of ratchet engaging teeth are formed;

wherein said ratchet engaging teeth of each of said v-pawl lever arm alternately engages a portion of said ratchet teeth at all times;

wherein at least one flex spring band has a first end and second end, wherein said first end is fixedly attached to a first pivotal v-pawl component, and said second end is fixedly attached to a second pivotal v-pawl component;

wherein said multi-position change detent has a plurality of grooves on a base side and where said multi-position change detent is in contact and exerts a variable force on said flex spring band when actuated by a thumb lever; and wherein a cover plate separates said thumb lever and said multi-position change detent.

2. The reversible ratchet wrench of claim 1, wherein said housing includes a cavity formed by a rounded inner surface and a series of v-pawl indentations adapted to correspond to the shape of said at least two pivotal v-pawl components and a change detent indentation adapted to correspond to the shape of said multi-position change detent.

3. The reversible ratchet wrench of claim 2, wherein said at least two pivotal v-pawl components pivot in two directions within said cavity, said at least two pivotal v-pawl components engage said ratcheted crescent, and wherein said cover plate covers said at least two pivotal v-pawl components and partially covers said ratcheted crescent within said cavity.

4. The reversible ratchet wrench of claim 1, wherein each of said v-pawl lever arms include a slit for engaging said flex spring band.

5. The reversible ratchet wrench of claim 1, wherein said multi-position change detent includes a slit of engaging said flex spring band.

6. The reversible ratchet wrench of claim 1, wherein said flex spring band is a leaf spring.

7. The reversible ratchet wrench of claim 1, wherein said thumb lever is fixedly attached to said multi-position change detent.

8. The reversible ratchet wrench of claim 1, wherein said cavity further includes a cover securing rim adapted to correspond to the shape of said cover plate.

9. The reversible ratchet wrench of claim 1, which further includes a coil spring connected to said housing and in contact with a ball bearing where said ball bearing engages said plurality of grooves on said multi-position change detent.

10. The reversible ratchet wrench of claim 1, wherein said at least two pivotal v-pawl components further include apertures for receiving a hinge component.

11. The reversible ratchet wrench of claim 10, wherein said hinge component is selected from the group consisting of a pin, a bolt, a threaded rod, a rivet, a roll pin and combinations thereof, and said structural component structurally engages said aperture within each of said pawls.

12. The reversible ratchet wrench of claim 1, which further includes more than two pivotal v-pawl components, wherein said more than two pivotal v-pawl components are spaced so that at least one of said plurality of ratchet engaging teeth on one of said at least two pivotal v-pawl components engage said ratcheted crescent at all times.

13. The reversible ratchet wrench of claim 1, wherein said plurality of ratchet engaging teeth are of varying length and sizes.

14. The reversible ratchet wrench of claim 1, wherein said v-pawl lever arms are of varying length and sizes.

15. The reversible ratchet wrench of claim 1, which further includes an ergonomic handle and a standard open-ended box wrench.

* * * * *